US006336801B1

(12) United States Patent
Fish et al.

(10) Patent No.: US 6,336,801 B1
(45) Date of Patent: Jan. 8, 2002

(54) DIE ASSEMBLY FOR A MELTBLOWING APPARATUS

(75) Inventors: Jeffrey E. Fish, Dacula; Lamar H. Gipson, Acworth; Jark C. Lau, Roswel, all of GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/336,295

(22) Filed: Jun. 21, 1999

(51) Int. Cl.[7] ..... D01D 5/12
(52) U.S. Cl. ..... 425/7; 425/72.2; 425/378.2
(58) Field of Search ..... 425/7, 72.2, 378.1, 425/378.2, 379.1

(56) References Cited

U.S. PATENT DOCUMENTS

| | | | | |
|---|---|---|---|---|
| 3,597,295 A | | 8/1971 | Tenquist | |
| 3,686,049 A | | 8/1972 | Manner et al. | |
| 4,077,410 A | | 3/1978 | Butterworth et al. | |
| 4,526,733 A | | 7/1985 | Lau | 264/12 |
| 4,818,464 A | * | 4/1989 | Lau | 425/7 |
| 5,002,476 A | | 3/1991 | Kerr | 425/388 |
| 5,061,170 A | * | 10/1991 | Allen et al. | 425/197 |
| 5,156,780 A | | 10/1992 | Kenigsberg et al. | 264/22 |
| 5,192,470 A | * | 3/1993 | Wilson et al. | 425/174.4 |
| 5,256,341 A | | 10/1993 | Denis et al. | 425/174.4 |
| 5,487,655 A | | 1/1996 | Frey et al. | 425/72.2 |
| 5,507,997 A | | 4/1996 | Evain | 264/464 |
| 5,632,938 A | | 5/1997 | Buehning, Sr. | 264/39 |
| 5,669,798 A | | 9/1997 | Koczab | 442/362 |
| 5,688,458 A | | 11/1997 | Koschienek et al. | 425/72.2 |
| 5,700,490 A | | 12/1997 | Meise | 425/72.2 |
| 5,728,407 A | | 3/1998 | Matsui | 425/7 |
| 5,788,993 A | | 8/1998 | Bryner et al. | 425/72.2 |
| 5,798,125 A | | 8/1998 | Zikeli et al. | 425/72.2 |

FOREIGN PATENT DOCUMENTS

WO (WO) 9932692 7/1999

OTHER PUBLICATIONS

U.S. application Ser. No. 09/471,531 filed Dec. 23, 1999.
International Search Report dated Oct. 24, 2000.

* cited by examiner

*Primary Examiner*—Nam Nguyen
*Assistant Examiner*—Joseph Leyson
(74) *Attorney, Agent, or Firm*—Dority & Manning, P.A.

(57) ABSTRACT

The present invention relates to an apparatus, including a die, for forming meltblown material. The die may further include a die tip and a heating element positioned proximate to the die tip to maintain the polymer material extruded from the die tip in a molten state.

8 Claims, 5 Drawing Sheets

DIE ASSEMBLY FOR A MELTBLOWING APPARATUS

BACKGROUND OF THE INVENTION

The present invention generally relates to the formation of fibers and nonwoven webs by meltblowing processes. More particularly, the present invention relates to an improved die assembly of a meltblowing apparatus.

The formation of fibers and nonwoven webs by meltblowing is well known in the art. See, by way of example, U.S. Pat. Nos. 3,016,599 to R. W. Perry, Jr.; U.S. Pat. No. 3,704,198 to J. S. Prentice; U.S. Pat. No. 3,755,527 to J. P. Keller et al.; U.S. Pat. No. 3,849,241 to R. R. Butin et al.; U.S. Pat. No. 3,978,185 to R. R. Butin et al.; U.S. Pat. No. 4,100,324 to R. A. Anderson et al.; U.S. Pat. No. 4,118,531 to E. R. Hauser; and U.S. Pat. No. 4,663,220 to T. J. Wisneski et al.

Briefly, meltblowing is a process type developed for the formation of fibers and nonwoven webs; the fibers are formed by extruding a molten thermoplastic polymeric material, or polymer, through a plurality of small holes. The resulting molten threads or filaments pass into converging high velocity gas streams which attenuate or draw the filaments of molten polymer to reduce their diameters. Thereafter, the meltblown fibers are carried by the high velocity gas stream and deposited on a collecting surface, or forming wire, to form a nonwoven web of randomly disbursed meltblown fibers.

Generally, meltblowing utilizes a specialized apparatus to form the meltblown webs from a polymer. Often, the polymer flows from a die through narrow cylindrical outlets and forms meltblown fibers. The narrow cylindrical outlets may be arrayed in a substantially straight line and lie in a plane which is the bisector of a V-shaped die tip. Typically the angle formed by the exterior walls or faces of the V-shaped die tip is 60 degrees and is positioned proximate to a pair of air plates, thereby forming two slotted channels therebetween along each face of the die tip. Thus, air may flow through these channels to impinge on the fibers exiting from the die tip, thereby attenuating them. As a result of various fluid dynamic actions, the air flow is capable of attenuating the fibers to diameters of from about 0.1 to 10 micrometers; such fibers generally are referred to as microfibers. Larger diameter fibers, of course, also are possible, with the diameters ranging from around 10 micrometers to about 100 micrometers.

In these processes, the polymer is heated to a temperature that will allow extrusion through the die outlets, which typically are about 0.1 inch (0.25 centimeter) long. The portion of the die tip in which the outlets are located is referred to herein as the die tip apex. The attenuating air is typically heated to maintain the temperature of the die tip and the exiting polymer to allow extrusion to proceed without plugging the outlets. The meltblown equipment generally utilizes air that is about the same temperature as the expelled polymer. Because the polymer and air velocities are the highest in the vicinity of the die tip apex, the transfer of heat from the die tip and the molten polymer exiting from the outlets is the greatest in that vicinity as well. Maintaining the air temperature as just described aids in keeping the polymer in the outlets hot and the viscosity of the exiting polymer low.

However, it has been recognized that there are many advantages to using as a primary drawing medium attenuating air that is much cooler than the temperature of the polymer within the die tip and exiting from the outlets. One advantage is that the fibers quench more rapidly and efficiently, resulting in a softer web and less likelihood of "shot", which, in one form, consists of fibers melted on the forming wire which form a stiff polymeric mass. Another advantage is that faster quenching may reduce the required forming distance between the die tip and the forming wire, thereby permitting the formation of webs with better properties, such as appearance, coverage, opacity, and strength.

With current die designs, the utilization of attenuating air at temperatures lower than those of the die tip and the exiting polymer would result in heat being transferred from polymer still present in the die tip. This loss of heat would increase the viscosity of the polymer and raise the pressure within the die tip to unacceptable levels. Furthermore, the increase in viscosity may be so extreme as a result of the temperature drop within the die tip to cause the polymer to practically solidify and plug the die tip.

Accordingly, there is a need for a meltblowing die that concentrates or focuses heat at the die tip, thereby permitting the use of attenuating air having temperatures significantly below the temperatures of the die tip and the polymer exiting therefrom.

SUMMARY OF THE INVENTION

The present invention addresses some of the difficulties and problems discussed above by providing a die that focuses heat at the die tip, and in particular at the die tip apex, by means other than heated attenuating air. Advantages of the invention will be set forth in part in the following description, or may be obvious from the description, or may be learned through practice of the invention.

One embodiment of the present invention is an apparatus for forming meltblown material. The apparatus may include a die having a die tip and a heating element positioned proximate to the die tip. Furthermore, the die may include a body and a die tip apex. The body and die tip may form a passageway for expelling polymer, and still further, the die may include at least one air plate. The air plate and die tip may form channels for the passage of air. The heating element may radiate heat to the die tip. Also, the heating element may transfer heat to the die tip apex, and furthermore, may directly radiate heat to the die tip apex. Moreover, the heating element may be an infrared lamp having a periphery coated with a reflective material around a portion of the periphery. Additionally, the polymer may be about 150° C. hotter than the air passing through the channels.

Another embodiment of the present invention is an apparatus for forming meltblown material that may include a die having a tip wherein at least one heating element may be embedded in the tip. Moreover, the heating element may be an electrical heating cartridge.

Still another apparatus for forming meltblown material may include a die having a die tip terminating in a die tip apex. The die tip may form at least one internal fluid passageway proximate to the die tip apex. The fluid passageway may be a conduit for a heated fluid for heating the die tip apex. Moreover, the die tip may form at least four internal fluid passageways for heating the die tip apex. Additionally, the internal fluid passageways may transport a fluid selected from the group comprising steam, oil, air, water, liquid metals, wax, and polymers. Furthermore, the fluid passageways may extend across the length of the die.

A further apparatus for forming a meltblown material may include a die. The die may further include a die tip terminating in a die tip apex and electrodes coupled to the die tip. A current may flow between electrodes heating the tip. Additionally, the current may flow the length of the die or alternatively, over the die tip apex. Furthermore, the die tip may form a passageway for expelling materials for forming a meltblown web and at least one electrode is positioned on either side of the passageway. Moreover, the apparatus may further include an electrical insulating layer.

DETAILED DESCRIPTION OF THE PREFERRED EMBODIMENT(S)

Figure 1:
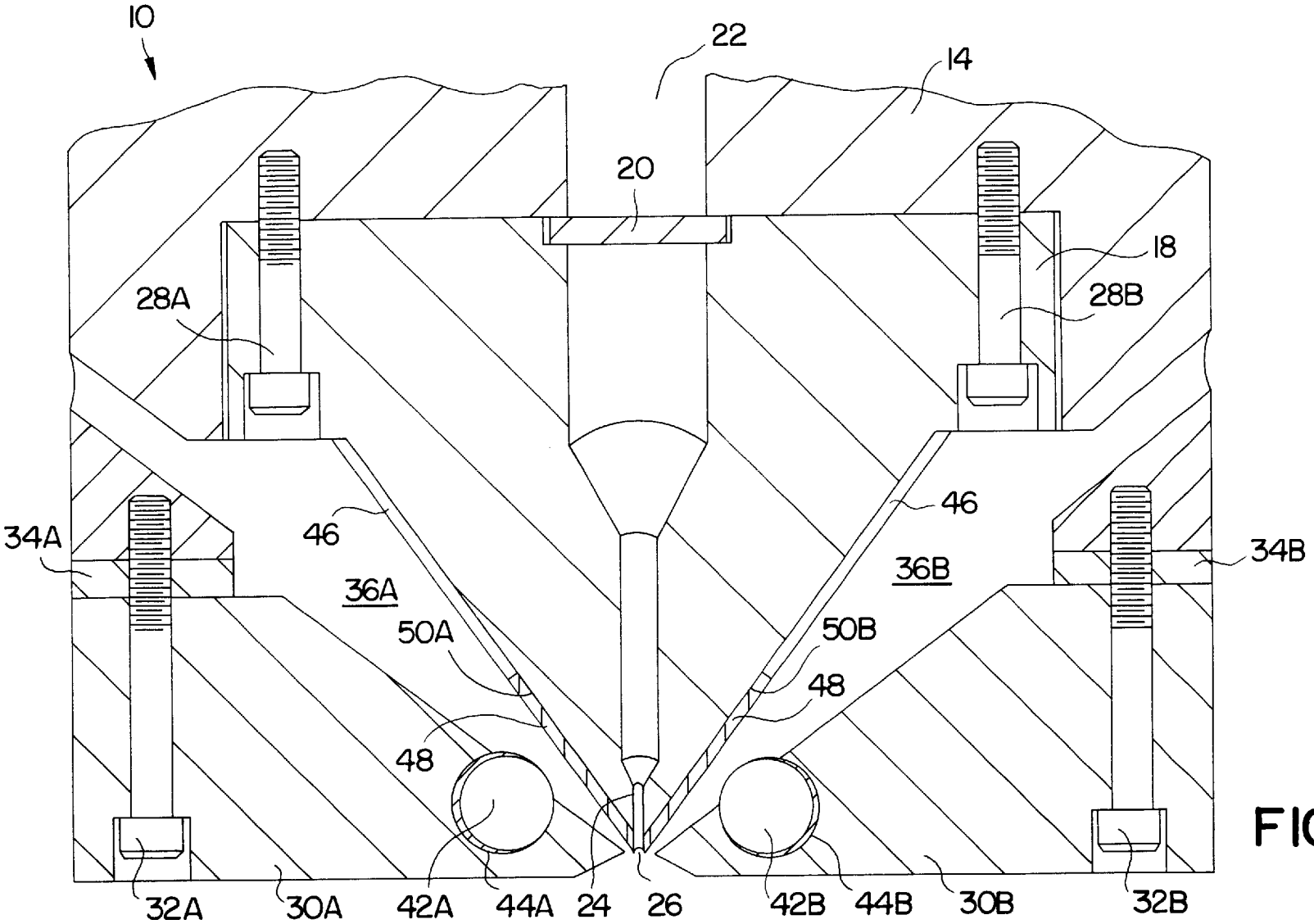
FIG. 1 is an enlarged, schematic cross-sectional view of a lower portion of an exemplary die.

Reference will now be made to the presently preferred embodiments of the invention, one or more examples of which are shown in the drawings. The examples are provided to explain the invention, and are not meant as a limitation of the invention.

As used herein, the term "nonwoven web" refers to a web that has a structure of individual fibers which are interlaid forming a matrix, but not in an identifiable repeating manner. Nonwoven webs have been, in the past, formed by a variety of processes known to those skilled in the art such as, for example, meltblowing, spunbonding, wet-forming and various bonded carded web processes.

As used herein, the term "meltblown web" means a web having fibers formed by extruding a molten thermoplastic material through a plurality of fine, usually circular, die capillaries as molten fibers into a high-velocity gas (e.g. air) stream which attenuates the fibers of molten thermoplastic material to reduce their diameters. Thereafter, the meltblown fibers are carried by the high-velocity gas stream and are deposited on a collecting surface to form a web of randomly disbursed fibers. The meltblown process is well-known and is described in the various patents and publications noted in the "BACKGROUND" section.

As used herein, the term "fiber" refers to a fundamental solid form, usually partially crystalline, characterized by relatively high tenacity and an extremely high ratio of length to diameter, such as several hundred or more to one. Exemplary natural fibers are wool, silk, cotton, and asbestos. Exemplary semisynthetic fibers include rayon. Exemplary synthetic fibers include spinneret extruded polyamides, polyesters, acrylics, and polyolefins.

As used herein, the term "heating element" refers to at least one device or arrangement for transmitting heat to a die tip. Exemplary heating elements are resistant electric cartridge heaters, electromagnetic radiation emitters, electrical contacts conducting current therebetween, and heated fluid passageways.

As used herein, the term "narrow cylindrical outlet" refers to the channel having the smallest cross-sectional area substantially perpendicular to the polymer flow in the die tip passageway, and generally, is the last channel prior to the polymer exiting the die tip.

As used herein, the term "die tip apex" refers to the area surrounding the narrow cylindrical outlet at the exit of the die tip.

As used herein, the term "gauge length" is the specimen length, typically reported in millimeters, measured between the points of attachment and may be abbreviated "gl". As an example, a fabric sample is tautly clamped in a pair of jaws. The initial distance between the jaws, generally about 75 millimeters, is the gauge length of the sample.

The term "machine direction" as used herein refers to the direction of travel of the forming surface onto which fibers are deposited during formation of a material.

The term "cross direction" as used herein refers to the direction in the same plane of the web which is perpendicular to machine direction.

As used herein, the term "grab tensile peak strain percent" refers to the increase in the gauge length (gl) at the maximum load expressed as a percentage of the original gauge length. The grab tensile peak strain percent may be calculated in the machine or cross direction of a specimen. The grab tensile peak strain percent may be calculated by the following formula:

$$\text{Peak Strain } \% = [((\text{length at maximum load}) - (gl))/(gl)] * 100$$

As used herein, the term "maximum load" refers to the maximum force applied to a specimen between the designated start and end measurements. Generally, this is the maximum force applied to a material carried to rupture.

As used herein, the term "peak energy" is the area under the load-elongation curve from the origin to the point of maximum load and may be expressed as "inch-pounds" and abbreviated "in.-lbs".

The present invention may be used with conventional meltblown equipment. One exemplary meltblown apparatus is disclosed in U.S. Pat. No. 4,526,733 to Lau, which is hereby incorporated by reference. Generally, a meltblown apparatus has a single die with a row of outlets for extruding polymers along its length.

A lower portion of an exemplary V-shaped die 10 of the present invention is depicted in FIG. 1. The die 10 may include a body 14, a die tip 18, and air plates 30 A–B. The die tip 18 may be attached to the body 14 using any suitable means, such as bolts 28A–B. The air plates 30 A–B may be secured proximate to the die tip 18 using any suitable means. The body 14 and die tip 18 may form a passageway 22 terminating in a narrow cylindrical outlet 26 for ejecting polymer material. Generally, this outlet 26 has a diameter of about 0.0145 in. (0.358 mm) and a length of about 0.1 in. (2.54 mm). Furthermore, the die tip 18 and air plate 30 may form channels 36 A–B for allowing air past the outlet 26. The die tip 18 may be in a recessed configuration with respect to air plates 30*a* and 30*b*.

The die tip 18 may include a die tip apex 24, a heat insulative coating 46, a heat absorbent coating 48, and a screen filter 20. The insulative coating 46 may be a low heat conductive material, such as ceramic paint, and the absorbent coating 48 may be a high heat absorbent material, such as black stove paint.

The air plates 30 A–B may include bolts 32A–B, spacing shims 34A–B, and heating elements 42A–B. The bolts 32A–B and spacing shims 34A–B may be used to adjust the air plates 30A–B and with respect to the die tip 18. At least one heating element 42A–B may be used, but desirably, two heating elements 42A–B may be utilized. The heating elements 42A–B may be resistant electric cartridge heaters or electromagnetic radiation emitters. As an example, the heating elements 42A–B may be quartz glass infrared lamps or emitters, such as those available from Hereaus-Amersil at Norcross, Ga. Desirably, these lamps are as small as possible yet give sufficient heat. As an example, these lamps may be 10 millimeters in diameter and extend longer than the length of the die tip 18. More desirably, these lamps emit 170 watts or more per in. (67 watts per cm). Moreover, these lamps may be coated with a reflective material 44A–B, such as gold, for about 270 degrees around the lamp's periphery. The uncoated periphery of the heating elements 42A–B may be positioned from about 0.01 in. (0.03 cm) to about 1 in. (2.54 cm) from the respective flank 50A–B of the die tip 18. Desirably, the uncoated periphery of the heating elements 42A–B may be positioned about 0.125 in. (0.32 cm) from the respective flank 50A–B of the die tip 18. Furthermore, the heating elements 42A–B may be embedded at least partially in respective air plates 30A–B to minimize the creation of turbulence in the air flow through the channels 36A–B.

When the heating elements 42A–B are activated, desirably they provide heat proximate to the die tip apex 24. The heating elements 42A–B may either radiate heat to the tip 18 near the die tip apex 24 where the heat may travel to the apex 24 by conduction, or desirably, the heating elements 42A–B may directly radiate heat to the apex 24. The radiated heat is absorbed by the absorbent coating 48 to aid heating the apex 24, and the insulative coating 46 helps maintain the heat within the tip 18.

Figure 2:
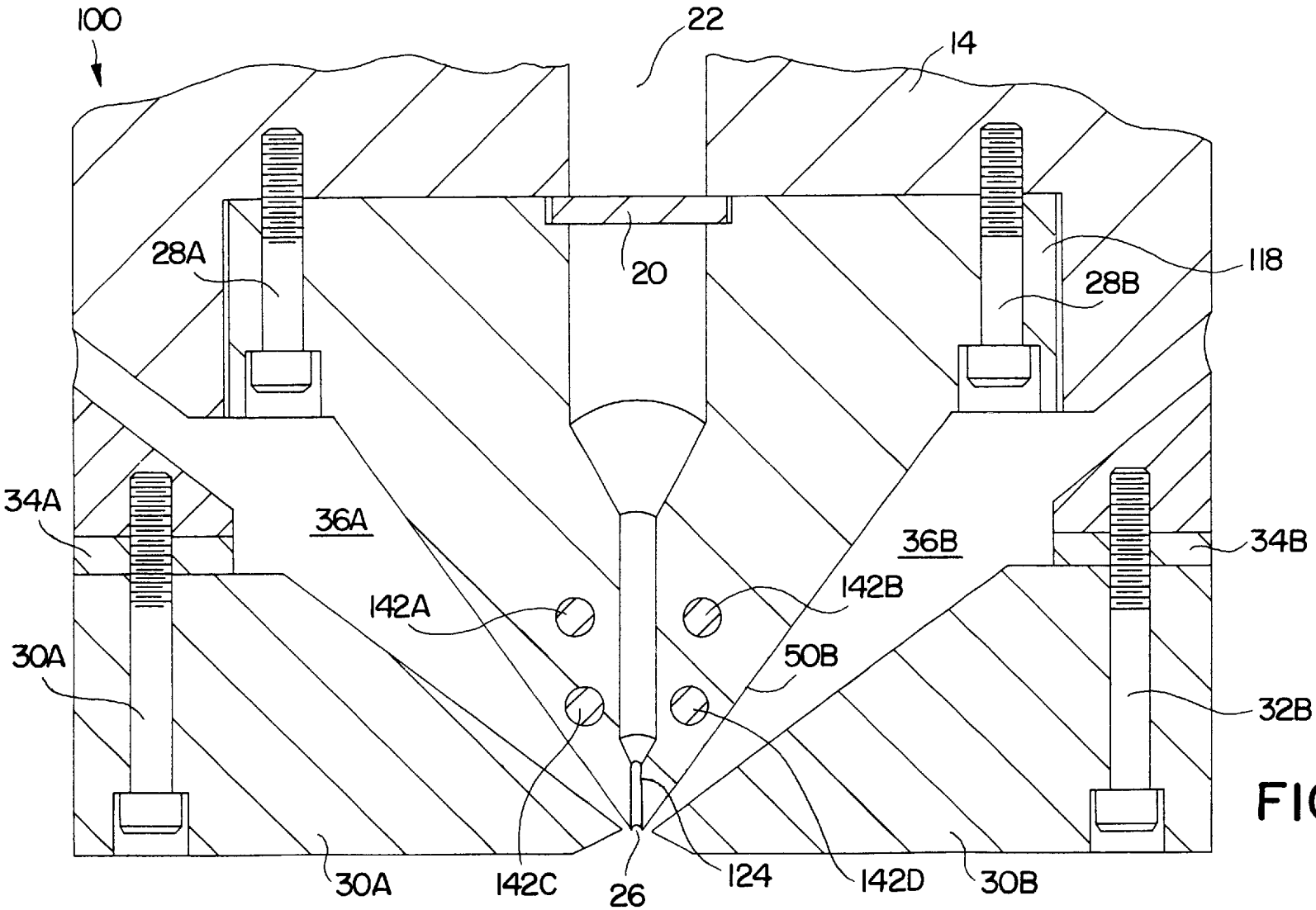
FIG. 2 is an enlarged, schematic cross-sectional view of a lower portion of another exemplary die.

Referring to FIG. 2, a lower portion of another exemplary V-shaped die 100 is depicted. The die 100 may include a die tip 118 and a die tip apex 124. The die tip 118 may have at least one embedded electric cartridge heater, although desirably four embedded electric cartridge heaters 142A–D are used. These cartridge heaters 142A–D provide heat to the polymer within the apex 124, and desirably, are positioned as close to the apex 124 as possible.

Figure 3:
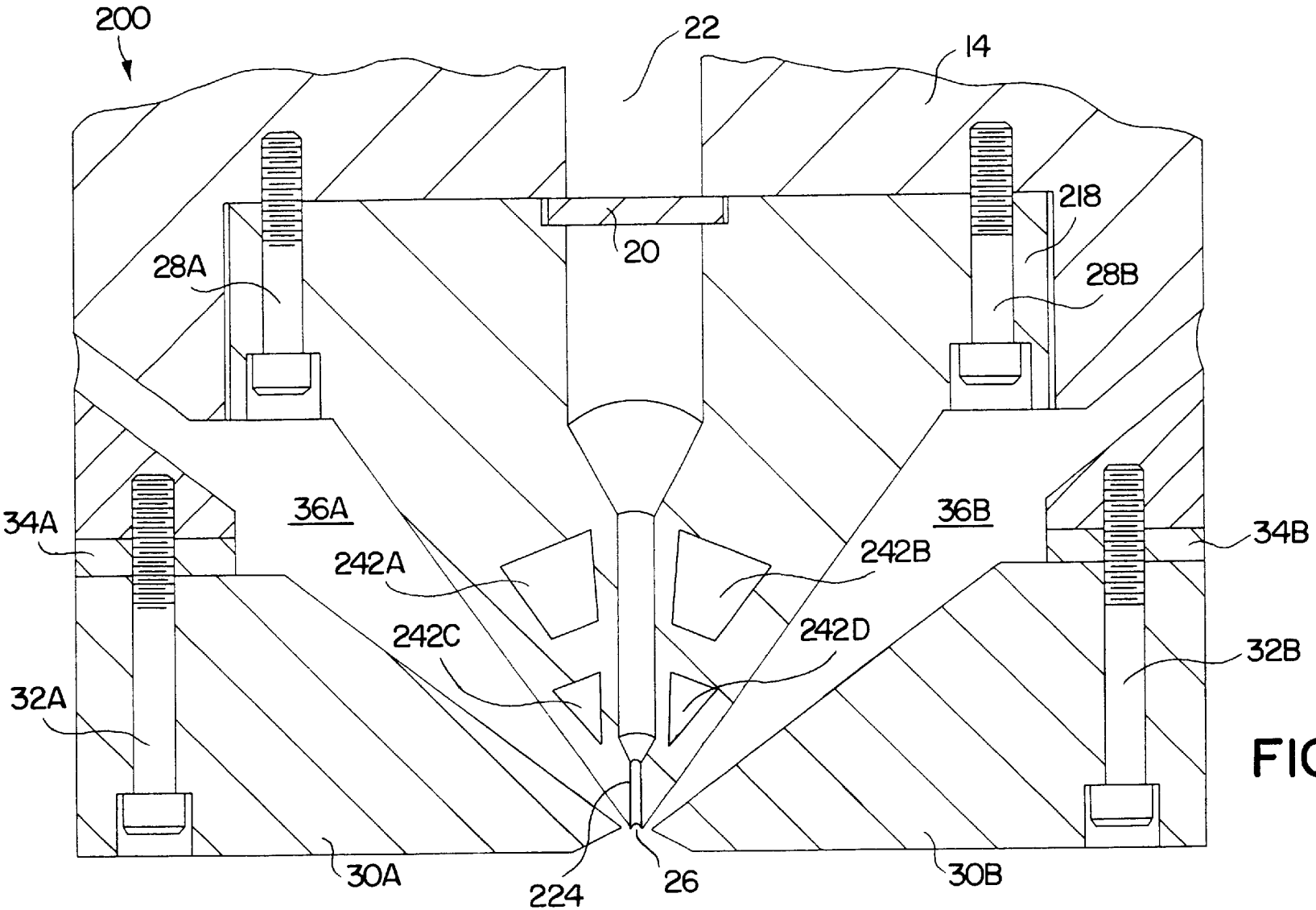
FIG. 3 is an enlarged, schematic cross-sectional view of a lower portion of still another exemplary die.

Referring to FIG. 3, another exemplary die 200 is depicted. The die 200 may include a die tip 218 and a die tip apex 224. Desirably, the die tip 218 has at least one passage extending the length of the die 200, although desirably four passages 242A–D extend the length of the die 200. These passages 242A–D may be filled with a heated fluid, such as steam, oil, polymer, wax, liquid metals, air, or water, that is pumped the length of the die 200 to heat a polymer within a die tip apex 224. Desirably, these passages 242A–D are positioned as close to the die tip apex 224 as possible.

Figure 4:
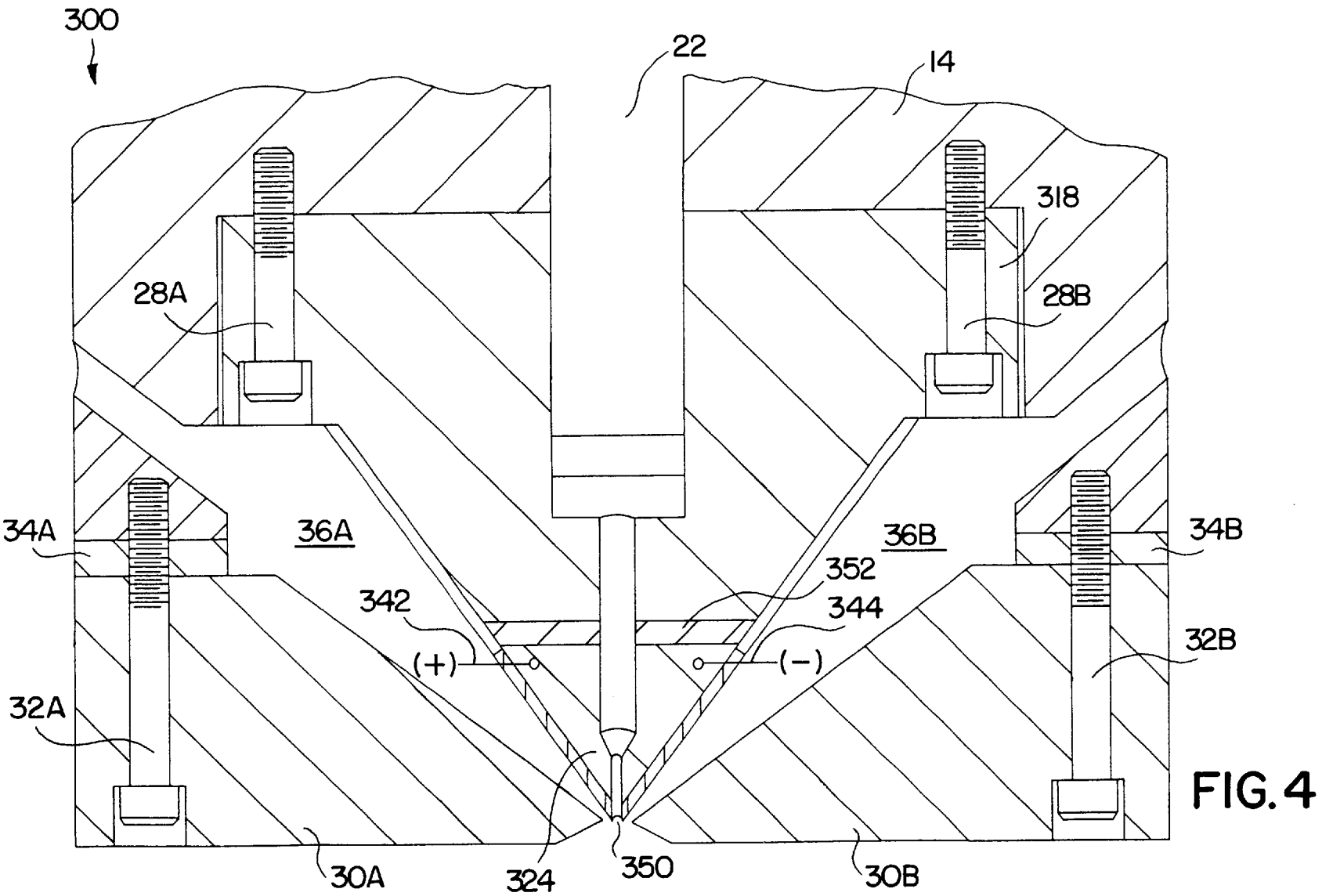
FIG. 4 is an enlarged, schematic cross-sectional view of a lower portion of an additional exemplary die.
Figure 5:
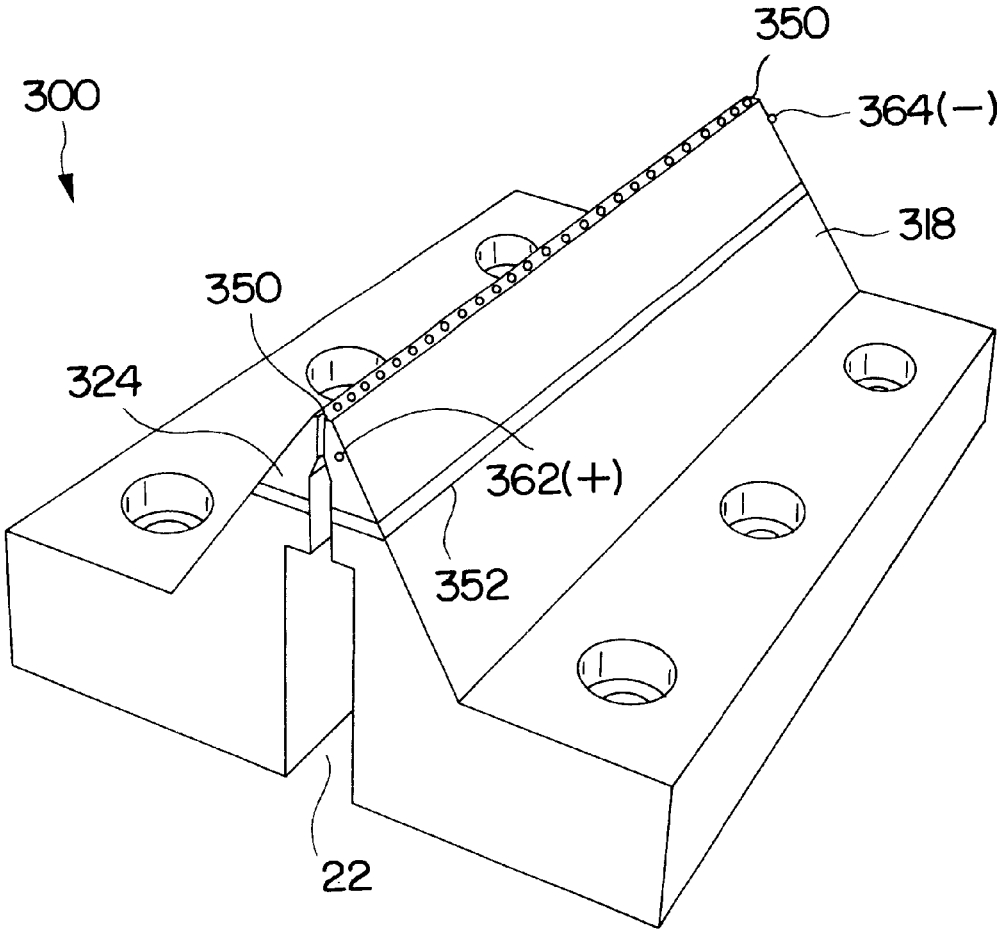
FIG. 5 is an inverted, perspective view of an exemplary die.

Referring to FIGS. 4 and 5, a still further exemplary die 300 is depicted. The die 300 may include a die tip 318, which in turn, may include a positive electrode 342, a negative electrode 344, an electrical insulating layer 352, and a die tip apex 324. Current may flow from the electrode 344 across the apex 324 of the die 300 between orifices 350 to the electrode 342, thereby using resistance in the apex material to heat the die tip 318, and more desirably, the die tip apex 324. Alternatively, referring to FIG. 5, the electrodes 362 and 364 may be placed at either end of the die 300 for causing current to flow lengthwise across the die 300. For either sets of electrodes 342 and 344, or 362 and 364, alternating current may be used. In some cases, the alternating current may be at a high frequency.

The present invention may form meltblown webs from materials such as polymers. Exemplary polymers include polyesters; polyolefins, such as polyethylene and polypropylene; polyamides, such as nylon; elastomeric polymers, and block copolymers. These materials may have melt flow rates varying from about 12 to about 1200 decigrams per minute. Exemplary polypropylenes are sold under the trade designation EXXON 3746G or EXXON 3505 by Exxon Chemical Company of Houston, Tex., or HIMONT PF-015 by Montell Polyolefins of Wilmington, Del.

The above-described tip-heating mechanisms decrease the viscosity of the polymeric material exiting the die. This added heat permits the use of higher viscosity materials for forming meltblown webs or the use of colder air to quench the polymeric material once it is expelled. The difference in temperature between the polymer in the die and the incoming air may vary from about 32° F. (0° C.) to about 700° F. (389° C.), or alternatively, may vary from about 200° F. (111° C.) to about 300° F. (167° C.). Moreover, the use of these heating mechanisms may result in a 20 to 25 percent reduction in the fiber denier, thus resulting in meltblown web having a finer fiber diameter. At least some of the benefits of the present invention are illustrated in the following examples.

Tests

The grab tensile test is a measure of breaking strength, grab tensile peak strain percent, and peak energy of a fabric when subjected to unidirectional stress. This test is known in the art and substantially conforms to the specifications of INDA IST 110.1-92. The results may be expressed as percent of the grab tensile peak strain or peak energy in either the machine or cross direction. Higher numbers indicate a stronger, more stretchable fabric.

The equipment included a constant rate of extension (CRE) unit along with an appropriate load cell and computerized data acquisition system. An exemplary CRE unit is sold under the trade designation SINTECH 2 manufactured by Sintech Corporation, whose address is 1001 Sheldon Drive, Cary, N.C. 27513. The type of load cell was chosen for the tensile tester being used and for the type of material being tested. The selected load cell had values of interest which fall between the manufacturer's recommended ranges of the load cell's full scale value. The load cell and the data acquisition system sold under the trade designation TestWorks™ may be obtained from Sintech Corporation as well.

Additional equipment included pneumatic-actuated jaws and precision sample cutter. The jaws were designed for a maximum load of 5000 g and may be obtained from Sintech Corporation. Each of the two jaws used for gripping either end of the specimen had a top or front jaw and a bottom or back jaw. The front jaw had a face measuring about 1 in. (25 mm) perpendicular to the direction of the load application and about 1 in. (25 mm) parallel to the direction of the load application. The back jaw had a face measuring about 3 in. (75 mm) perpendicular to the direction of the load application and about 1 in. (25 mm) parallel to the direction of the load application. A precision sample cutter was used to cut samples within 4±0.125 inch (102±3 mm) wide and 6±0.125 inch (152±3 mm) long. An exemplary sample cutter is sold under the trade designation JDC by Thwing-Albert Instrument Co., of Philadelphia, Pa.

Tests were conducted in a standard laboratory atmosphere of 23±2° C. (73.4±3.6° F.) and 50±5% relative humidity. The two principal directions, machine and cross, of the material was established. The specimens had a width of about 4 in. (102 mm) and a length of about 6 in. (152 mm). The length of the specimen was in the cross or machine direction of the material being tested depending on whether the machine or cross direction grab tensile peak strain percent or peak energy was being measured. Desirably, the test specimens were free of tears or other defects, and had clean cut, parallel edges.

The tensile tester was prepared as follows. A load cell was installed for the type of tensile tester being used and for the type of material being tested. A load cell was selected so the values of interest fell between the manufacturer's recommended ranges of the load cell's full scale value. The separation speed of the jaws was set at 12±0.5 inch/minute (305±13 mm/minute). The break sensitivity was set at about 20% or at a higher level if the material required it.

The testing procedure began by inserting the specimen centered and straight into the jaws. Next, the jaws extending across the specimen's width were closed while simultaneously excessive slack was removed from the specimen. Afterward the machine was started and the jaws separated. The test ended when the specimen ruptured. That being done, the results were recorded.

EXAMPLES

The following examples utilize a die tip having a narrow, cylindrical outlet extending about 0.1 in. (0.25 cm) into the die from the point of the die tip apex, a die length of about 20 in. (51 cm), and a gap between the air plates of about 0.18 in. (0.46 cm). The following examples also utilized infrared lamps available from Hereaus-Amersil at Norcross, Ga. These lamps were about 10 millimeters in diameter and extended longer than the length of the die tip. Furthermore, these lamps emitted about 170 watts per in. (67 watts per cm). Moreover, these lamps were coated with a reflective material, such as gold, for about 270 degrees around the lamps'periphery. The uncoated peripheries of the lamps were positioned about 0.125 in. (0.318 cm) from the respective flanks of the die tip. These lamps were either operated at 100 percent of emitter capacity or turned off during the formation of meltblown materials.

Example 1

This example compared the pressure of the tip with the lamps turned on and off. In this example, polypropylene having a melt flow rate of about 1500 decigrams per minute was used and a web of basis weight of about 0.5 oz/yd$^2$ (17 g/m$^2$) was made. The polymer was heated to a temperature of about 420° F. (216° C.) and was expelled at a throughput rate of about 1.84 lbs/(in.*hr) (329 g/(cm*hr)). Air flow was at a temperature of about 358° F. (181° C.) and a pressure of about 4.5 psig (31,000 Pa). The forming height was about 11 in. (28 cm) and the underwire vacuum was operated at a water column of about 15 in. (38 cm). These parameters were held substantially constant while the apparatus was run with the lamps on and off. The pressure at the die body was recorded as depicted in TABLE 1 below:

TABLE 1

| Infrared Emitters | Die Body Pressure psig (kPa) |
|---|---|
| OFF | 230 (1600) |
| ON | 140 (1000) |

As depicted in TABLE 1, operating the apparatus with the infrared lamps lowered the pressure in the die body within about 5 seconds as a result of the reduction in the apparent viscosity of the polymer.

Example 2

This example compared meltblown webs made at a low air quench temperature with the lamps turned on and meltblown webs made at a high air quench temperature with the lamps turned off. In this example, polypropylene having a melt flow rate of about 1500 decigrams per minute was utilized and a web having a basis weight of about 0.5 oz/yd$^2$ (17 g/m$^2$) was made. The polymer was heated to a temperature of about 420° F. (216° C.) and was expelled at a throughput rate of about 1.84 lbs/(in.*hr) (329 g/(cm*hr)). Air flow was at a pressure of about 4.3 psig (30,000 Pa). The form height was about 11 in. (28 cm) and the underwire vacuum was operated at a water column of about 15 in. (38 cm). These parameters were held substantially constant while the apparatus was run with the lamps on and off and the air temperature was varied. The air temperature used with the lamps on was below the freezing point of the polymer. The results of this test are depicted in TABLE 2:

TABLE 2

| | Air | Die Body | Grab Tensile Peak Strain | |
|---|---|---|---|---|
| Infrared Emitters | Temperature ° F. (° C.) | Pressure psig (kPa) | Machine Direction | Cross Direction |
| OFF | 463 (239) | 80 (551) | 39% | 54% |
| ON | 170 (77) | 120 (826) | 99% | 65% |

The grab tensile peak strain of the web was higher with cool air compared with the hot air control sample. The use of infrared emitters to heat a meltblowing die tip produced meltblown materials with properties unattainable in typical meltblowing. The use of cold primary air in the process caused a much more rapid and efficient polymer quench, resulting in softer material. With the faster quench, and less heat in the forming area, the forming distance may be reduced to as short as 3 in. (8 cm). This shorter distance results in improved formation, and as a consequence, a better appearance, uniformity, and opacity; and results in improved strength as indicated by the grab tensile peak strain results.

Example 3

This example compared forming meltblown fabrics from polypropylene having different molecular weights, as indicated by their respective melt flow rates. A higher melt flow rate correlated generally with a lower molecular weight. The produced webs had about the same basis weight of about 0.5 oz/yd$^2$(17 g/m$^2$). In this example, the underwire vacuum was operated at a water column of about 15 in. (38 cm), air pressure at about 4 psig (27,000 Pa), and the lamps were operating at 100 percent emitter capacity. While these parameters were held substantially constant, the polymer melt temperature, polymer flow rate, air temperature, forming height, and polymer throughput were varied, as depicted in TABLE 3:

TABLE 3

| Polypropylene Melt Flow Rates | 1500 dg/min | 35 dg/min |
|---|---|---|
| Polymer Temperature | 400° F. (204° C.) | 550° F. (288° C.) |
| Air Temperature | 358° F. (181° C.) | 500° F. (260° C.) |
| Forming Height | 11 in. (28 cm) | 7 in. (18 cm) |
| Peak Energy (Machine Direction) | 1.5 in.-lbs (1700 cm-g) | 4.7 in.-lbs (5400 cm-g) |
| Peak Energy (Cross | 1.1 in.-lbs | 4.4 in.-lbs |

TABLE 3-continued

| Polypropylene Melt Flow Rates | 1500 dg/min | 35 dg/min |
|---|---|---|
| Direction) | (1300 cm-g) | (5100 cm-g) |
| Polymer Throughput | 1.84 lbs/(in.*hr.) (329 g/(cm*hr)) | 1.0 lbs/(in.*hr) (179 g/(cm*hr)) |

Infrared emitters were used to heat the die tip to a higher temperature than the rest of the system, lowering the viscosity in the die outlet sufficiently to meltblow polymers with higher molecular weights than are typically used. The residence time in the die tip is relatively short, so even at elevated temperatures there is little thermal degradation. High molecular weight resins offer the potential of a higher strength, toughness, and melting point nonwoven. The toughness of this web is indicated by the peak energy data in TABLE 3. Generally resins of low viscosity and consequently high meltflow rate are used. These tend to be low molecular weight polymers or polymers having additives to lower viscosity, such as peroxide. The potential strength of the fibers is therefore lower than fibers made from higher molecular weight resins.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, to modifications and equivalents as can be included within the spirit and scope of the following claims.

What is claimed is:

1. An apparatus for forming meltblown material from a molten polymer, said apparatus comprising:

a die configured with channels through which molten polymer is extruded for forming meltblown fibers, said die further comprising a die tip having a die tip apex defining outlets at extreme ends of said channels, said outlets having the smallest cross-sectional area of said channels;

at least one pair of air plates disposed relative to said die tip to define air channels proximate to said die tip for directing attenuating air against the molten polymer fibers extruded from said outlets; and a heating element disposed generally across from said die tip apex and said outlets for radiating heat thereto across said air channels so that attenuating air directed through said air channels may be at a temperature below that necessary to maintain said polymer in a molten state.

2. The apparatus as in claim 1, wherein said heating element comprises at least one infrared lamp disposed adjacent said die tip apex.

3. The apparatus as in claim 2, wherein said infrared lamp comprises a periphery which is surrounded with a reflective material around a portion thereof so as to direct heat towards said die tip apex.

4. The apparatus as in claim 1, wherein said heating element is embedded at least partially within at least one of said air plates.

5. The apparatus as in claim 1, wherein said die tip further comprises an electrical insulating layer disposed for insulating said die tip apex from the rest of said die tip.

6. The apparatus as in claim 1, further comprising a heat absorbing coating on said die tip apex.

7. An apparatus for forming meltblown material from a molten polymer, said apparatus comprising:

a die configured with channels through which molten polymer is extruded for forming meltblown fibers, said die further comprising a die tip defining outlets for said channels, said die tip comprising a die tip apex defining said outlets;

at least one pair of air plates disposed relative to said die tip to define air channels proximate to said die tip for directing attenuating air against the molten polymer fibers extruded from said outlets;

a heating element disposed relative to said die tip for radiating heat essentially to said die tip apex so that said polymer is heated primarily by said heating element so that attenuating air directed through said air channels may be at a temperature below that necessary to maintain said polymer in a molten state, said heating element comprising at least one infrared lamp disposed adjacent to said die tip apex; and wherein said infrared lamp is contained at least partially in one of said air plates.

8. An apparatus for forming meltblown material from a molten polymer, said apparatus comprising:

a die configured with channels through which molten polymer is extruded for forming meltblown fibers, said die further comprising a die tip defining outlets for said channels, said die tip comprising a die tip apex defining said outlets;

at least one pair of air plates disposed relative to said die tip to define air channels proximate to said die tip for directing attenuating air against the molten polymer fibers extruded from said outlets; and a heating element disposed relative to said die tip for transferring heat essentially to said die tip apex so that said polymer is heated primarily by said heating element and attenuating air directed through said air channels may be at a temperature below that necessary to maintain said polymer in a molten state;

wherein said heating element comprises at least one set of electrodes in electrical contact with said die tip generally to direct an electrical current through said die tip between said electrodes; and wherein said die tip further comprises an electrical insulating layer contained therein and disposed for insulating said die tip apex from the rest of said die tip.

* * * * *